US011613033B2

(12) United States Patent
Petratou et al.

(10) Patent No.: US 11,613,033 B2
(45) Date of Patent: Mar. 28, 2023

(54) SHAVING BLADE ASSEMBLIES

(71) Applicant: BIC VIOLEX S.A., Anoixi (GR)

(72) Inventors: Irene Petratou, Athens (GR); Giorgos Georgakis, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 0 days.

(21) Appl. No.: 16/973,640

(22) PCT Filed: Jul. 18, 2019

(86) PCT No.: PCT/EP2019/069347
§ 371 (c)(1),
(2) Date: Dec. 9, 2020

(87) PCT Pub. No.: WO2020/016348
PCT Pub. Date: Jan. 23, 2020

(65) Prior Publication Data

US 2021/0245380 A1 Aug. 12, 2021

(30) Foreign Application Priority Data

Jul. 18, 2018 (EP) ..... 18184272

(51) Int. Cl.
*B26B 21/44* (2006.01)
*B26B 21/40* (2006.01)

(52) U.S. Cl.
CPC ..... *B26B 21/443* (2013.01); *B26B 21/4012* (2013.01); *B26B 21/446* (2013.01)

(58) Field of Classification Search
None
See application file for complete search history.

(56) References Cited

U.S. PATENT DOCUMENTS

| | | | | |
|---|---|---|---|---|
| 4,562,644 | A | 1/1986 | Hitchens | |
| 4,813,131 | A | 3/1989 | Gruner | |
| 5,036,587 | A * | 8/1991 | Trotta | B26B 21/44 30/41 |
| 5,713,131 | A | 2/1998 | Rogers et al. | |
| 7,703,361 | B2 * | 4/2010 | Johnson | B26B 21/44 83/13 |

(Continued)

FOREIGN PATENT DOCUMENTS

| | | | |
|---|---|---|---|
| CN | 105219007 B | | 1/2018 |
| CN | 110312599 A | * | 10/2019 |

(Continued)

OTHER PUBLICATIONS

International Search Report and Written Opinion in International Application No. PCT/EP2019/069347, dated Oct. 8, 2019 (12 pages).

*Primary Examiner* — Hwei-Siu C Payer
(74) *Attorney, Agent, or Firm* — Bookoff McAndrews, PLLC

(57) ABSTRACT

The present disclosure is related to shaving blade assemblies comprising a housing having at least one cavity; a shaving aid support having one or more lubricating elements thereon, the shaving aid support being rotatably attached to the housing about a center axis, wherein at least a shaft portion of the shaving aid support is disposed in the at least one cavity of the housing.

19 Claims, 3 Drawing Sheets

(56) References Cited

U.S. PATENT DOCUMENTS

| | | | | |
|---|---|---|---|---|
| 8,191,263 | B2 * | 6/2012 | Folio | B26B 21/44 30/538 |
| 8,236,214 | B2 | 8/2012 | Kwiecen | |
| 2005/0126007 | A1 | 6/2005 | Aviza | |
| 2005/0198826 | A1 * | 9/2005 | Segrea | B26B 21/44 30/41 |
| 2009/0223057 | A1 | 9/2009 | Coope-Epstein et al. | |
| 2010/0107416 | A1 | 5/2010 | Folio | |
| 2013/0042482 | A1 | 2/2013 | Bradford et al. | |
| 2015/0040402 | A1 * | 2/2015 | Carneiro | B26B 21/443 30/41 |
| 2015/0107114 | A1 * | 4/2015 | Minsk | B26B 21/44 30/41 |
| 2016/0129603 | A1 | 5/2016 | Antoniou et al. | |
| 2016/0338928 | A1 | 11/2016 | Haught et al. | |
| 2021/0245380 | A1 * | 8/2021 | Petratou | B26B 21/443 |
| 2021/0252726 | A1 * | 8/2021 | Brette | B26B 21/443 |
| 2021/0308888 | A1 * | 10/2021 | Gratsias | B26B 21/44 |

FOREIGN PATENT DOCUMENTS

| | | | |
|---|---|---|---|
| EP | 0551407 | B1 | 6/1996 |
| EP | 1252985 | A2 | 10/2002 |
| EP | 1935588 | A1 | 6/2008 |
| EP | 2078593 | A1 | 7/2009 |
| GB | 2342884 | A | 4/2000 |
| JP | 2019-531799 | * | 11/2019 |
| WO | 2009135159 | A1 | 11/2009 |
| WO | 2014194934 | A1 | 12/2014 |
| WO | WO 2019/022043 | A1 * | 1/2019 |

* cited by examiner

SHAVING BLADE ASSEMBLIES

CROSS REFERENCE TO RELATED APPLICATION(S)

This application is a National Stage Application of International Application No. PCT/EP2019/069347, filed on Jul. 18, 2019, now published as WO2020016348 and which claims priority from European Application No. EP18184272.5, filed on Jul. 18, 2018.

TECHNICAL FIELD

The present description relates to shaving blade assemblies, and more specifically, to shaving blade assemblies comprising a rotatable shaving aid support that may have a lubricating element thereon.

PRIOR ART

Shaving blade assemblies that provide shaving aid via rotating/spinning mechanisms are known in the art. For example, US 2005/0198826 concerns a razor with a cartridge that includes a roller having a lubricating material.

Similarly, EP 1 252 985 concerns a razor with a cartridge including a guard/dispenser roller with cylindrical roller surface acting both as a guard for the leading blade and as a means for transferring shaving aid material.

GB 2 342 884 concerns a razor that a lubricant is poured into the handle. The lubricant is applied to the user's skin through a roller applicator in the head of the shaver.

US 2016/0129603 discloses the concept of a shaving aid that can be slidably or reversibly mounted on a frame of an adaptor.

In another example, US 2010/0107416 discloses the concept of a separable lubrication, which can be pivoted rearward relative to the frame.

EP 1 935 588 discloses the concept of a shaving aid member that reciprocates between initial and end positions.

During repeated shaving operations, the shaving aid disposed on a shaving aid support may be consumed and typically before the razor blades are dulled. Thus, the skin may not be properly lubricated for the useful life of the razor blades. Therefore, it is desirable to provide an improved rotatable shaving aid support on the razor head for shaving durability enhancement.

SUMMARY

According to aspects of the present disclosure, a shaving blade assembly is provided. The shaving blade assembly may comprise a housing that may have at least one cavity and a shaving aid support that may have one or more lubricating elements thereon. The shaving aid support may be rotatably attached to the housing about a center axis. At least a shaft portion of the shaving aid support may be disposed in the at least one cavity of the housing. The shaving aid support has a first side and a second side, where the first side has a first lubricating element thereon and the second side has a second lubricating element thereon. With the provision of a shaving aid support with one or more lubricating elements being rotatably attached to the housing, the user can rotate the shaving aid support such that additional lubricating material can be used and the lubricating capacity of the shaving blade assembly is extended rendering it useful for longer. Moreover, the fact that the shaving aid support is rotatably mounted about the center axis of the housing provides for a symmetric alignment of the housing with the body portion of the shaving aid support. This means that the skin surface that comes in contact with the cutting edges of the blades during shaving is lubricated sufficiently via the symmetrically-arranged lubricating elements of the body of the shaving aid that follow the footprint of the blades in the skin. This provides enhanced lubrication during shaving as well as additional shaver durability. Further, this configuration allows for a customizable shaving blade assembly that can address different needs of the user, for example, the user can select among different lubricating formulas that contribute several skin benefits. Also, the volume or exposure of the lubricating element on the shaving aid support can be customized, according to the user's preferences.

Providing multiple lubricating elements increases the useful life of the shaving blade assembly as well as allowing different types of lubricating elements being used on a single shaving blade assembly.

According to some embodiments, the sides may have a substantially flat outer surface.

According to some embodiments, the shaving aid support may have two or more lubricating elements thereon.

According to some embodiments, the housing may further include at least one recess and the shaving aid support may include at least one pin. The recess and pin may be configured to removeably lock together.

The pin and recess prevent unwanted movement of the shaving aid support during a shaving operation.

According to some embodiments, the at least one recess may be formed in a top portion and a back portion of the housing.

In some examples, the at least one recess may be provided in the top and back portions of the housing allows for the shaving aid support to be manipulated via the back of the housing and not the front of the housing where the blades may be located. This reduces the risk of a user injuring themselves while manipulating the shaving aid support.

According to some embodiments, the housing may further include a pair of prongs extending vertically from the top portion of the housing. The prongs provide an alternative method for securing the shaving aid support relative to the housing.

According to some embodiments, the shaving aid support may be disposed between the prongs. Disposing the shaving aid support between the prongs can help prevent unwanted movement of the shaving aid support during a shaving operation.

According to some embodiments, the shaving aid support may be in contact with a top portion of the housing when in a first position and may be in contact with a bottom portion of the housing when in a second position. With this configuration, a user can choose between a sensitive or more aggressive shave. In particular, when the shaving aid support is in the first configuration, the lubricating element is trailing the blades in a shaving operation, thus allowing for a more aggressive shave when compared to when the shaving aid support is in the second position and is leading the blades, thus allowing for a more sensitive shave.

According to some embodiments, the shaving aid support may include at least one shaft portion, wherein the at least one cavity of the housing may be configured to be rotatably attached to the at least one shaft portion and prevent translation of the shaving aid support. With this configuration, the connection of the shaft portion and the at least one recess can prevent unwanted movement of the shaving aid support during a shaving operation.

According to some embodiments, the shaving aid support may be configured to rotate about a center axis that is orthogonal to a longitudinal axis of the housing. With this configuration, the shaving aid support may have a compact design that can allow for easy storage.

According to some embodiments, the shaving aid support may be configured to rotate about a center axis that is a longitudinal axis of the housing. With this configuration, a user can choose between a sensitive or more aggressive shave by selecting whether the lubricating element is either leading or trailing the blades.

According to some embodiments, the shaving aid support may comprise a body portion and a shaft portion extending from the body portion.

According to some embodiments, the body portion may comprise a prism shaped section.

According to some embodiments, the body portion may be U-shaped.

According to some embodiments, the shaving blade assembly may further comprise one or more blades arranged within the housing.

In some aspects, a razor may be provided; the razor may comprise a shaving blade assembly as disclosed herein and a handle.

In these aspects, the shaving blade assembly may be used with a handle to aid a user during the shaving process.

In examples, the handle may be releasably connected to the shaving blade assembly. In this configuration, a user may keep the handle of the razor and the shaving blade assembly may be interchangeable which reduces cost to the user.

The above summary is not intended to describe each and every implementation of the concept. In particular, selected features of any illustrative embodiment within this disclosure may be incorporated into additional embodiments unless clearly stated to the contrary or otherwise incompatible.

BRIEF DESCRIPTION OF THE DRAWINGS

The disclosure may be more completely understood in consideration of the following detailed description of non-limiting aspects of the disclosure in connection with the accompanying drawings, in which.

Figure 1A:
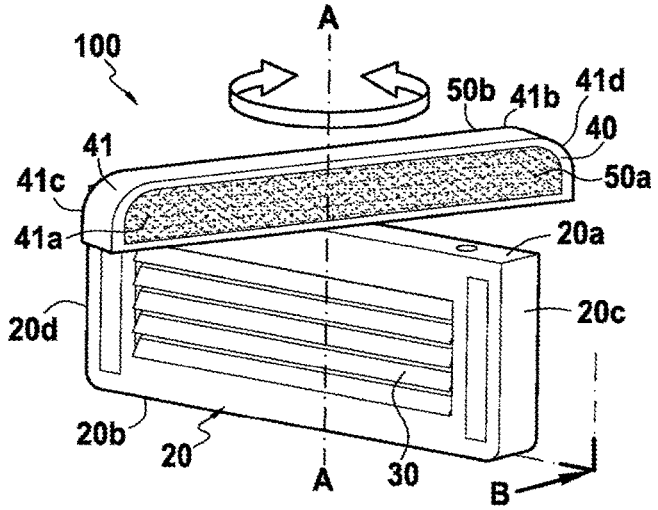
FIG. 1A is a perspective view of an exemplary shaving blade assembly according to some embodiments.

While aspects of the disclosure are amenable to various modifications and alternative forms, specifics thereof have been shown by way of example in the drawings and will be described in detail. It should be understood, however, that the intention is not to limit aspects of the disclosure to the particular embodiment described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the present disclosure. The illustrative aspects depicted are intended only as exemplary.

Throughout the present description and claims a side should be understood as a geometrically defined side, i.e. being delimited by edges and/or corners. In this sense, it is submitted that a cylinder has a circular cross-section that cannot be considered as comprising geometrical sides.

FIGS. 1A-3C depict a shaving blade assembly 100 that may include a housing 20 and a rotatable shaving aid support 40 that may be rotatably attached to the housing 20. The shaving blade assembly 100 may be specifically adapted for shaving facial, head, and/or body hair.

The lubricating elements 50*a*, 50*b* that is disposed on the shaving aid support 40 may comprise a two-layered structure, where the bottom layer, which is attached to the shaving aid support 40, contains a lubricious composition and the top, outermost, layer contains a thin, hydrophobic film so as to keep the lubricating surfaces protected. This film can protect the first used lubricating element 50*a* on the first face 41*a*, 341*a* of the shaving aid support 40 until the film wears off due to abrasion. Additionally, this film protects the lubricating element 50*b* on the second face 41*b*, 341*b* from being depleted before being used.

The hydrophobic film works by creating a micro- or nano-sized structure on a surface providing water-repellent properties. Indicative examples of hydrophobic coatings may be manganese oxide polystyrene (MnO2/PS) nano-composite, zinc oxide polystyrene (ZnO/PS) nano-composite, fluorinated silanes and fluoropolymer coatings and silica-based coatings, which are gel-based and can be easily applied either by dipping the object into the gel or via aerosol spray. These hydrophobic structures are thin and very delicate, and thus can be easily damaged by wear due to abrasion/friction. Therefore, after the first few times a razor is used, the hydrophobic layer of the first used lubricating element 50*a* wears off, revealing the layer with the lubricious composition, while the second face 41*b*, 341*b* remain protected during shaving.

The lubricious composition of the bottom layer of each face 41*a*, 41*b*, 341*a*, 341*b* can fundamentally comprise a water-soluble component (e.g., polyethylene oxide generally known as POLYOX or ALKOX) and a water-insoluble component (e.g. high impact polystyrene). Examples of rigid water-insoluble components are polystyrene, styrene co-polymers, polyethylene, polypropylene, polyacetal, acrylonitrile-butadiene-styrene copolymer, ethylene vinyl acetal copolymer, polylactic acid, polycarbonate, maleic anhydride ethylene co-polymer blends, polyether-containing block copolymers (e.g. with polyamide), blends and copolymers of the above with or without other additives. Examples of elastic water-insoluble components are thermoplastic elastomer compounds (TPEs), more specifically thermoplastic poly-urethanes, and/or silicone polymers. Typical examples of water-soluble components are polyethylene oxide and/or polyethylene glycol, polyvinyl pyrrolidone, polyacrylamide, polyhydroxymethacrylate, polyvinyl imidazoline, polyvinyl alcohol, polyhydromethymethacrylate, silicone polymers, blends and copolymers of the above. The lubricious composition may additional contain other ingredients selected in the group of plasticizers, such as low molecular weight polyethylene glycols, water-swellable release enhancing agents, such as cross-linked polyacrylics and/or maleic anhydride compounds, additional lubricants, compatibilizers, and/or skin care agents selected in the group consisting of vitamins, botanical extracts, salts, humectants, silicon oils, organic oils, waxes, antioxidants, exfoliants, anti-bacterial agents, anti-microbial, antiseptics, biocides, preservatives, skin soothing agents, hydrating agents, skin protectants, colorants, film formers, processing thickening agents from the list of silica, fume silica, $TiO_2$ particles, and combinations thereof. The lubricious composition of each face 41*a*, 41*b*, 341*a*, 341*b* may be different including several cosmetic ingredients that achieve multiple skin benefits. Alternative lubricious compositions are known and disclosed in patent applications, such as in US20090223057—where as additional ingredients may be included emulsifiers, surfactants, skin conditioners, fragrances, depilatory agents, cleaning agents, medicinal agents; U.S. Pat. No. 8,236,214—where as additional ingredient may be included mineral oil; U.S. Pat. No. 5,713,131, US2016338928—where as additional ingredients may be included cooling agents; US2013042482—where as additional ingredients may be included anti-irritation agents such as a pyrithione or a polyvalent metal salt of pyrithione; CN105219007—where as additional ingredient may be included moisturizing agent selected from olive oil, jojoba oil and glycerin; EP0551407—where as additional ingredients may be included essential oil materials such as menthol, eugenol, eucalyptol, saffrol or methyl salicylate. One of skill will understand that the lubricating elements as disclosed herein may be available in different compositions, and that any such lubricating elements may be suitable for use with embodiments of the present disclosure.

Figure 1B:
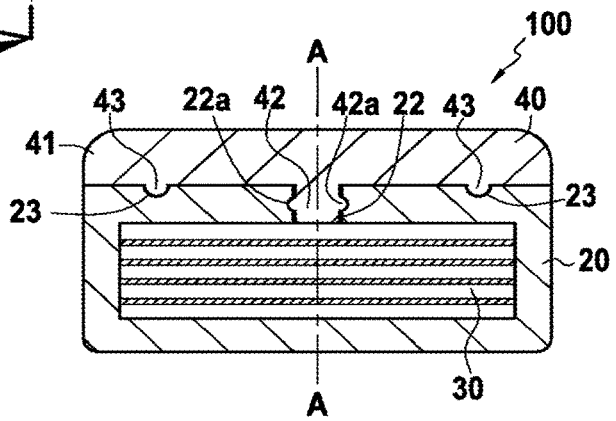
FIG. 1B is a cross-section of the shaving blade assembly of FIG. 1A.

FIGS. 1A and 1B show a shaving blade assembly 100 having a housing 20 that may be formed in a prism shape having e.g. a rectangular base. In alternatives, the housing may have any other prism shape, for example an oval shape. The housing may comprise a top portion 20*a*, bottom portion 20*b*, side end portions 20*c*, 20*d*, back portion 20*g*, and front portion 20*h*. The housing 20 may also include a guard bar and a pair of retainers adapted to retain the position of at least one blade 30 within the housing 20, for example, the retainers may be substantially c-shaped.

In this embodiment, a plurality of blades 30 are shown, however, it is contemplated that the shaving blade assembly 100 may have any number of blades 30 arranged within the housing 20 (e.g., 1 blade, 2 blades, 3 blades, 4 blades, etc.). Additionally, the blades 30 that are shown are elongate in shape. It is further contemplated that the blades 30 may be formed as any other suitable shape for cutting hair.

The blades 30 may traverse the housing 20 between the side end portions 20*c*, 20*d*. The blades 30 may be partially exposed through an opening in the housing 20. Each blade 30 may have two ends that correspond with the side end portions 20*c*, 20*d* of the housing 20. Each of the blades 30 may have a blade edge 32 that is configured to contact the surface of a user's skin during a shaving operation.

The blade assembly 100 may further include a shaving aid support 40 having a body portion 41 and a shaft portion 42 extending therefrom. The body portion 41 may be elongated in shape and e.g. shaped substantially as a rectangular prism having a first face 41*a* and a second face 41*b* that is opposite from the first face 41*a*. It is envisioned that the shaving aid support 40 may be formed as any other suitable shape, for example, a semicylinder.

In examples, the shaft portion 42 may be formed substantially cylindrical and may extend from the center of the body portion 41.

In examples, the body portion 41 of the shaving aid support 40 may have dimensions according to the following example: a length of the body portion 41 of the shaving aid support 40 may be 29-45 mm; a width of the body portion 41 of the shaving aid support 40 may be 4-5 mm; and a height of the body portion 41 of the shaving aid support 40 may be 5-5.5 mm. In some examples, the shaving aid support 40 may be composed of a polymer (e.g., an injection molded thermoplastic) or any other rigid material, for example, a metal.

In some examples, the housing 20 may have a cavity 22 that is configured to correspond with the shaft portion 42 of the shaving aid support 40. Further in these examples, the cavity 22 may be positioned such that it is centered on a vertical central axis A-A, i.e. an axis orthogonal to a longitudinal axis of the housing. The shaft portion 42 may be rotatably connected to the housing 20 via the cavity 22. This may be achieved, for example, by a snap fit connection. For example, a protrusion 42*a* may be formed on the shaft portion 42 which corresponds with a recess 22*a* formed on the surface of the housing 20 inside of the cavity 22. It is envisioned that any other mechanical or magnetic connection means may be used.

In some examples, the shaving aid support 40 may further comprise at least one lubricating element 50*a* disposed on at least a portion of the surface of the body portion 41. In some of these examples, the lubricating element 50*a* may be disposed on the first face 41*a* of the body portion 41 of the shaving aid support 40. In some examples, an additional lubricating element 50*b* may be disposed on the second face 41*b* of the body portion 41 of the shaving aid support 40.

The shaving aid support 40 may be oriented in a first position such that the lubricating element 50*a* on the first face 41*a* trails the blade edges 32. In this configuration, the lubricating element 50*a* is configured to contact the surface of a user's skin during a shaving operation.

In examples, in order to secure the shaving aid support 40 in the first position, the shaving aid support 40 may have at least two protuberances 43 extending from the bottom of the body portion 41. The protuberances 43 may be opposed to each other about the shaft portion 42 of the shaving aid support 40. The protuberances 43 may be adapted to be removeably lodged into the corresponding recesses 23 formed in the top portion 20*a* of the housing 20.

In operation, when a user desires to change from the lubricating element 50*a* disposed on the first face 40*a* to the lubricating element 50*b* disposed on the second face 40*b*, the user may apply a rotational force to the shaving aid support 40. This rotational force dislodges the protuberances 43 of the shaving aid support 40 from the recesses 23 formed on the top portion 20*a* of the housing 20. This permits the shaving aid support 40 to rotate relative to the housing 20 about its shaft portion 42 until the protuberances 43 of the shaving aid support 40 are relodged into the recesses 23 formed on the top portion 20*a* of the housing 20, thereby positioning the second face 41*b* of the shaving aid support 40 to trail the blade edges 32. With this configuration, the user can rotate the shaving aid support 40 such that the lubricating element 50*b* on the second face 41*b* can be used and the useful life of the shaving assembly 100 is extended.

Figure 1C:
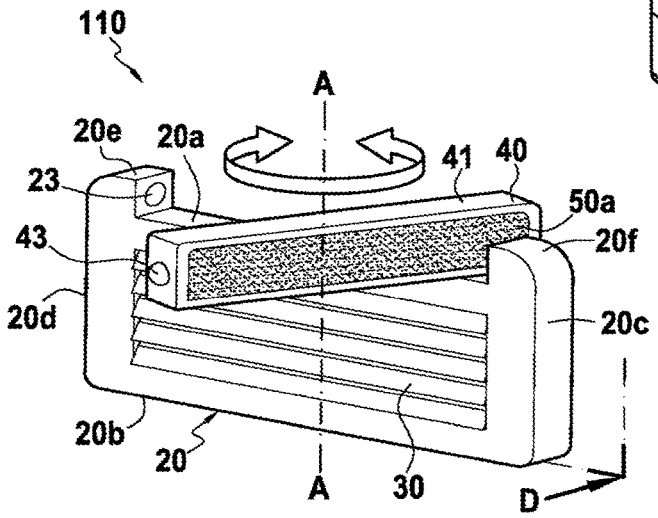
FIG. 1C is a perspective view of a shaving blade assembly according to further embodiments.
Figure 1D:
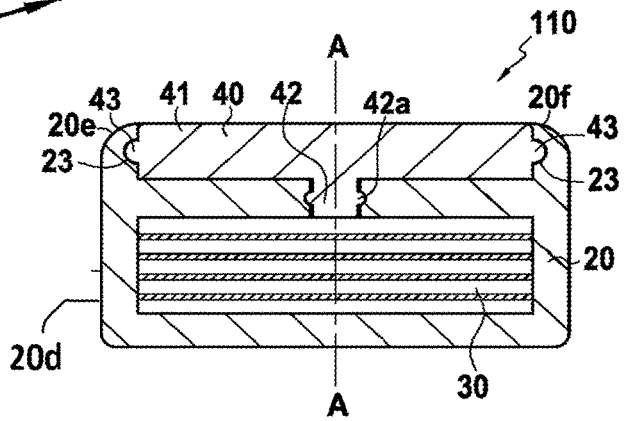
FIG. 1D is a cross-section of the shaving blade assembly of FIG. 1C.

FIGS. 1C and 1D show a shaving blade assembly 110 that is the same as the shaving blade assembly 100, except that the shaving aid support 40 may be housed in a recess of the housing 20. Therefore, the detailed description of similar features will be omitted and like reference signs will be used.

In blade assembly 110 shown in the example of FIGS. 1C-1D, the housing 20 may be fork shaped having a first prong 20*e* and a second prong 20*f* extending vertically from the top portion 20*a* of the housing 20 thereby defining the recess on which the shaving aid support 40 may be housed. The shaving aid support 40 may thus be dimensioned such that it can be disposed between the prongs 20*e*, 20*f* of the housing 20. For example, the shaving aid support 40 may have the dimensions according to the following: a length of the body portion 41 of the shaving aid support 40 may be 24-37 mm; a width of the body portion 41 may be 3.5 mm; a height of the body portion 41 may be 3.5 mm; a length of each of the first and second prongs 20*e*, 20*f* may be 2-5 mm; a height of the prongs 20*e*, 20*f* may be 5-5.5 mm; a width of the prongs 20*e*, 20*f* may be 4-5 mm; a length of the top portion 20*a* (excluding the length of the prongs 20*e*, 20*f*) may be 25-35 mm.

Furthermore, in order to secure the shaving aid support 40 in the first position, the shaving aid support 40 may have at least two protuberances 43 that are opposed to each other. Each of the protuberances 43 may extend from respective side end portions 20*c*, 20*d* of the body portion 41. The protuberances 43 may be adapted to be removeably lodged into corresponding recesses 23 formed in the first and second prongs 20*e*, 20*f* of the housing 20.

In operation, when a user desires to change from the lubricating element 50*a* disposed on the first face 40*a* to the lubricating element 50*b* disposed on the second face 40*b*, the user may apply a rotational force to the shaving aid support 40. This rotational force dislodges the protuberances 43 of the shaving aid support 40 from the recesses 23 formed on the a first and second prongs 20*e*, 20*f* of the housing 20. This permits the shaving aid support 40 to rotate relative to the housing 20 about its shaft portion 42 until the protuberances 43 of the shaving aid support 40 are relodged into the recesses 23 formed on the first and second prongs 20*e*, 20*f* of the housing 20, thereby positioning the second face 41*b* of the shaving aid support 40 to trail the blade edges 32.

Similar to the blade assembly 100, the configuration of blade assembly 110 allows the use life of the shaving assembly to be extended. This way a shaving aid that may be on one of the lubricating elements 50*a*, 50*b* may be used till the blades 30 become dull. Therefore, the user can rotate the shaving aid support 40 such that the lubricating element 50*b* on the second face 41*b* can be used and the use life of the lubricating element 50*a*, 50*b* and blades 30 can be aligned. Additionally, the prongs 20*e*, 20*f* can help protect the shaving aid support 40 from unwanted movement during a shaving operation.

Figure 1E:
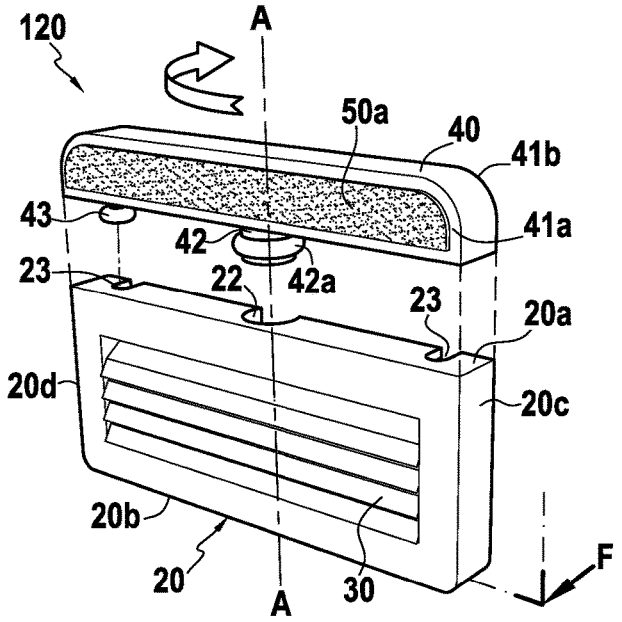
FIG. 1E is a perspective view of a shaving blade assembly according to still further embodiments.
Figure 1F:
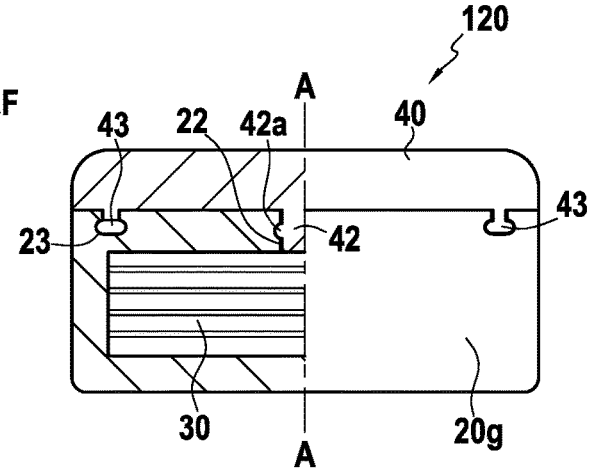
FIG. 1F is a cross-section of the shaving blade assembly of FIG. 1E.

FIGS. 1E and 1F show a shaving blade assembly 120 that is the same as shaving blade assembly 100, except that the means for securing the shaving aid support 40 in the first and second positions may be a pin 43. Therefore, the detailed description of similar features will be omitted and like reference signs will be used.

In blade assembly 120 shown in the example of FIGS. 1E-1F, the housing 20 may include at least two recesses 23 that are formed in the top portion 20*a* and a back portion 20*g* of the housing 20. Each recess 23 has the same radial distance from the center axis A-A. The center axis A-A may be orthogonal to a longitudinal axis of the housing 20 thereby being considered a vertical center axis with respect to the housing 20.

The shaving aid support 40 may have a pin 43 that extends vertically from the bottom surface of the body portion 41 of the shaving aid support 40. The pin 43 may be formed to be substantially T-shaped. In more examples, it is envisioned that the pin 43 may be formed in any suitable shape, for example a cylinder having a portion with larger diameter than the remaining cylinder portion, this being configured to snap fit and rotate about the housing 20. The pin 43 may be positioned offset from the vertical center axis A-A such that it corresponds with each of the recesses 23. The pin 43 may be adapted to be removeably lodged in each of recesses 23. For example, the pins 43 may be secured to the housing 20 through elastic deformation of the support-housing structure.

In operation, when a user desires to change from the lubricating element 50*a* disposed on the first face 40*a* to the lubricating element 50*b* disposed on the second face 40*b*, the user may apply a rotational force the shaving aid support 40. This rotational force dislodges the pin 43 of the shaving aid support 40 from a recess 23 formed in the housing 20. This permits the shaving aid support 40 to rotate relative to the housing 20 about its shaft portion 42 until the pin 43 is lodged in the other recess 23, thereby positioning the second face 41*b* of the shaving aid support 40 to trail the blade edges 32 secured in the housing 20.

Similar to the blade assembly 100, the configuration of blade assembly 120 allows the use life of the shaving assembly to be extended. This way a shaving aid that may be on one of the lubricating elements 50*a*, 50*b* may be used till the blades 30 become dull. Therefore, the user can rotate the shaving aid support 40 such that the lubricating element 50*b* on the second face 41*b* can be used and the use life of the lubricating element 50*a*, 50*b* and blades 30 can be aligned.

Figure 1G:
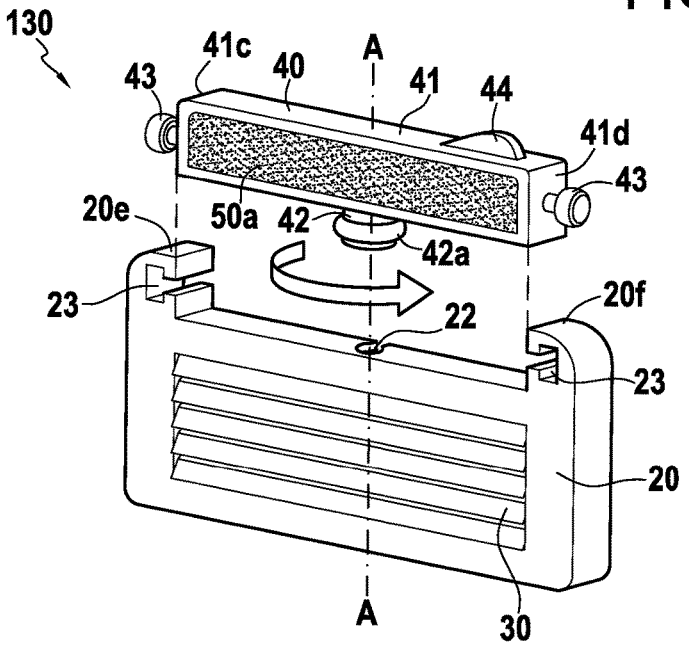
FIG. 1G is a perspective view of a shaving blade assembly according to still further embodiments.

FIG. 1G shows a shaving blade assembly 130 that is the same as shaving blade assembly 100, except that the housing 20 may have prongs 20*e*, 20*f* and the means for securing the shaving aid support 40 in the first and second positions may be a pair of pins 43. Therefore, the detailed description of similar features will be omitted and like reference signs will be used.

In blade assembly 130 shown in the example of FIG. 1G, the housing 20 may be fork shaped having a first prong 20*e* and a second prong 20*f* extending vertically from the top portion 20*a* of the housing 20. The shaving aid support 40 may be dimensioned such that it can be disposed between the prongs 20*e*, 20*f* of the housing 20. For example, the shaving aid support 40 may have the dimensions, according to the following example: a length of the body portion 41 of the shaving aid support 40 may be 24-37 mm; a width of the body portion 41 may be 3.5 mm; a height of the body portion 41 may be 3.5 mm; a length of each of the first and second prongs 20*e*, 20*f* may be 2-5 mm; a height of the prongs 20*e*, 20*f* may be 5-5.5 mm; a width of the prongs 20*e*, 20*f* may be 4-5 mm; a length of the top portion 20*a* (excluding the length of the prongs 20*e*, 20*f*) may be 25-35 mm.

Each prong 20*e*, 20*f* may include a recess 23, for example, a C-shaped recess. The recesses 23 may be formed to face each other, e.g., mirrored about a vertical plane that lies on the vertical center axis A-A and parallel to the side end portions 20*c*, 20*d* of the housing 20.

The shaving aid support 40 may have at least two pins 43 that are formed substantially, for example, as T-shaped. Each of the pins 43 may extend horizontally from a respective side ends 41*c*, 41*d* of the body portion 41 of the shaving aid support 40. Although a T-shaped member is mentioned, it is envisioned that the pins 43 may be formed in any suitable shape for example, a cylinder. A portion of such a cylindrical pin 43 may have a larger diameter than the remaining cylinder portion to remain assembled e.g., via snap-fit.

Each of the pins 43 may be positioned and configured to be removeably lodged in each of recesses 23.

In operation, when a user desires to change from the lubricating element 50*a* disposed on the first face 40*a* to the lubricating element 50*b* disposed on the second face 40*b*, the user may apply a rotational force to the shaving aid support 40. This rotational force dislodges the pins 43 of the shaving aid support 40 from the respective recesses 23 formed in the housing 20. This permits the shaving aid support 40 to rotate relative to the housing 20 about its shaft portion 42 until the pins 43 are relodged in the respective recesses 23, thereby positioning the second face 41*b* of the shaving aid support 40 to trail the blade edges 32.

Furthermore, the shaving aid support 40 may further include a flange 44 which may be used to aid a user with rotating the shaving aid support 40. The flange 44 may be positioned in any appropriate place on the shaving aid support 40.

Similar to the blade assembly 100, the configuration of blade assembly 130 allows the use life of the shaving assembly to be extended.

Figure 2A:
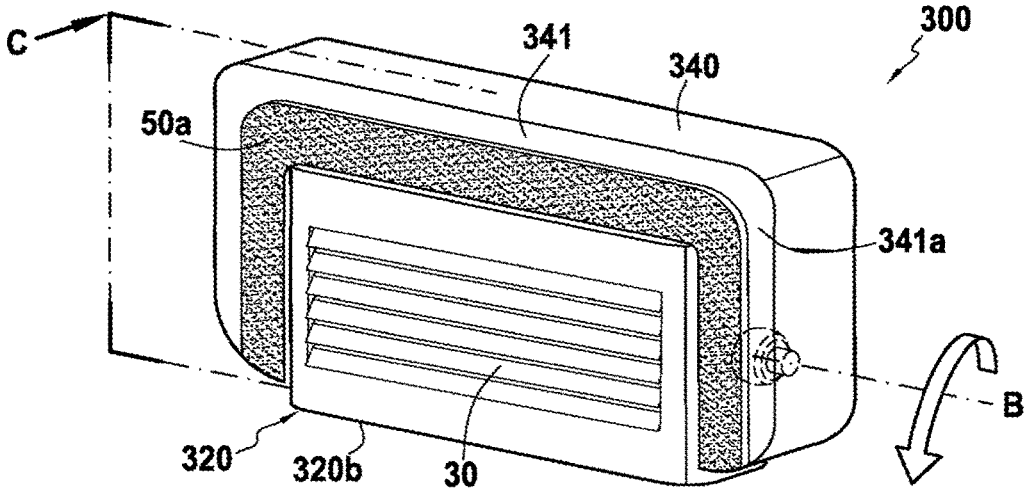
FIG. 2A is a perspective view of a shaving blade assembly according to further embodiments.
Figure 2B:
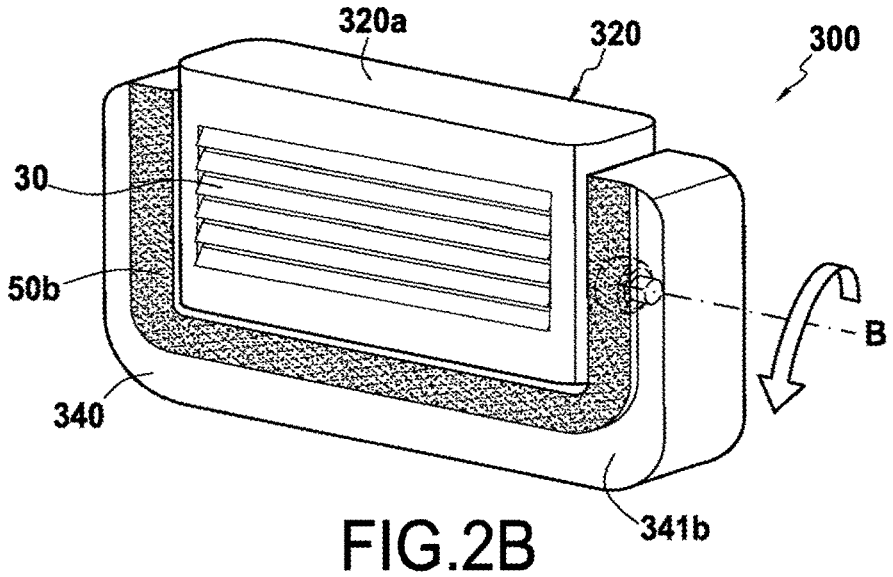
FIG. 2B is a perspective view of the shaving blade assembly according to FIG. 2A.
Figure 2C:
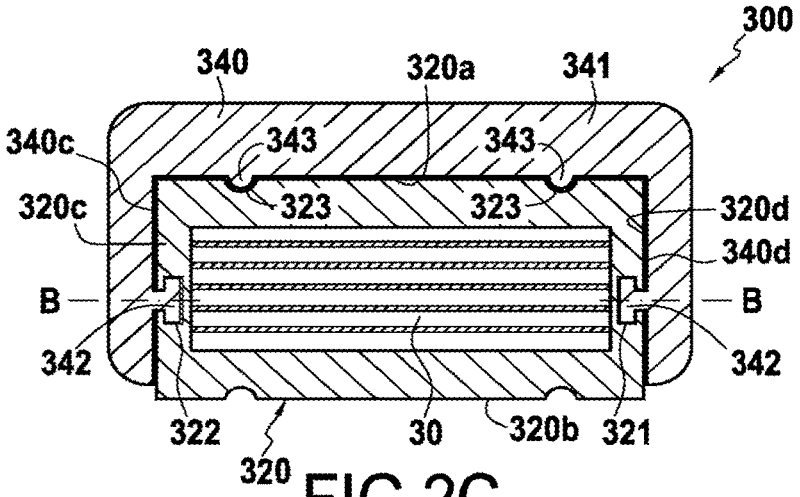
FIG. 2C is a cross-section the shaving blade assembly according to FIG. 2A.

FIGS. 2A-2C show a shaving blade assembly 300 that has similar features as the shaving blade assembly 100. Therefore, the detailed description of similar features will be omitted and like reference signs will be used.

The housing 320 of the blade assembly 300 shown in the example of FIGS. 2A-2C may include a pair of cavities 321, 322 that may be formed in a respective side ends 320*c*, 320*d* of the housing 320. Each of the cavities 321, 322 may extend partially in the housing 320 or entirely through the housing 320.

The blade assembly 300 may further include a shaving aid support 340 having a body portion 341 and a pair of shaft portions 342 extending therefrom.

The body portion 341 may be a U-shaped prism and may be configured to surround at least a portion of the exterior surface of the housing 320. However, it is envisioned that the shaving aid support 340 may be formed as any other suitable shape. The body portion 341 further has a first face 341*a* and a second face 341*b* that is opposite from the first face 341*a*. Each of the first and second faces 341*a*, 341*b* may have a lubricating element 50*a*, 50*b* disposed thereon. The body portion 341 of the shaving aid support 340 may have dimensions according to the following: a length of the shaving aid support 340 may be 37-47 mm; a width of the shaving aid support 340 may be 3-5 mm; a height of the shaving aid support 340 may be 10-15 mm. The shaving aid support 340 may be composed of a polymer or any other suitable material, for example a metal.

Each of the shaft portions 342 may be formed, for example, substantially T-shaped. The shaft portions 342 may be disposed on a respective interior side surface 340*c*, 340*d* of the shaving aid support 340. The shaft portions 342 may be disposed on the body portion 341 of the shaving aid support 340 such that each of the shaft portions 342 corresponds with a respective cavity 321, 322 of the housing 320. The shaving aid support 340 and the housing 320 may be rotatably attached to each other via the respective cavities 321, 322 and shaft portions 342. The shaving aid support 340 may be rotatable about a center horizontal axis B-B of the housing 320. The center axis B-B may be a longitudinal axis of the housing 320. The respective cavities 321, 322 are adapted to prevent translation of the shaving aid support 340 while permitting rotation of the shaving aid support 340 relative to the housing 320.

Although a pair of cavities 321, 322 and a pair of shaft portions 342 are shown and will be discussed in relation to this embodiment, this embodiment is merely exemplary and any number of cavities 321, 322 and shaft portions 342 may be used.

In order to secure the shaving aid support 340 in the first and second positions, the shaving aid support 340 may have at least one protuberance 343 extending from the interior surface 340*a* of the body portion 341. This protuberance 343 may be adapted to be removeably lodged into corresponding recesses 323 formed on respective top and bottom portions 320*a*, 320*b* of the housing 320.

In operation, when a user desires to move the shaving aid support 340 from a first position to a second position to switch between the lubricating element 50*a* disposed on the first face 340*a* to the lubricating element 50*b* disposed on the second face 340*b*, the user may apply a rotational force to the shaving aid support 340. This rotational force dislodges the protuberance 343 of the shaving aid support 340, for example, within a recess 323 formed on the top portion 320*a* of the housing 320. This permits the shaving aid support 340 to rotate relative to the housing 320 about its shaft portions 342 until the protuberance 343 of the shaving aid support 340 is lodged into the recess 323 formed on the bottom portion 320*b* of the housing 320, thereby positioning the second face 341*b* of the shaving aid support 340 to lead the blade edges 32 during a shaving operation.

With this configuration, a user can rotate the shaving aid support 340 such that the lubricating element 50*b* on the second face 341*b* can be used and the useful life of the shaving assembly is extended. Further, having the ability to place the lubricating element 50*b* in a position that leads the blades 30 can provide a user with a more sensitive shave which can reduce skin irritation.

It is envisioned that the features of the above-mentioned embodiments are combinable when not conflicting. For example, the flange 44 as a gripping feature may be incorporated into any of the embodiments. Additionally, the lubricating elements 50*a*, 50*b* may have the same shaving aid thereon or they may have different types of shaving aids.

In some aspects of the disclosure, it includes a razor (not shown) having a shaving blade assembly substantially as herein disclosed and a handle (not shown). The handle may extend along the vertical central axis A-A. The handle may have a top portion and a bottom portion. The handle may be shaped to better adapt to the natural contours of a hand. The top portion of the handle may have a connecting member that may be adapted to connect to the housing of the shaving blade assembly. Alternatively, the shaving blade assembly may be monolithically formed with the handle, it may be fixed to the handle, or it may be releasably connected with the handle and thus it may further be interchangeable with the handle.

Throughout the description, including the claims, the term "comprising a" should be understood as being synonymous with "comprising at least one" unless otherwise stated. In addition, any range set forth in the description, including the claims should be understood as including its end value(s)

unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A shaving blade assembly comprising:

at least one blade;

a housing having at least one cavity;

a shaving aid support that is rotatably attached to the housing about a central axis, wherein at least one shaft portion of the shaving aid support is disposed in the at least one cavity of the housing, wherein the shaving aid support has a first side and a second side, wherein the first side has a first lubricating element thereon and the second side has a second lubricating element thereon, and wherein the central axis is an axis orthogonal to a longitudinal axis of the housing.

2. The shaving blade assembly of claim 1, wherein each of the sides has a substantially flat outer surface.

3. The shaving blade assembly of claim 1, wherein one or more of the first lubricating element and the second lubricating element comprise a two-layered structure.

4. The shaving blade assembly according to claim 1, wherein the at least one cavity of the housing is configured to correspond with the at least one shaft portion such that the at least one cavity of the housing permits rotation of the shaving aid support relative to the housing.

5. The shaving blade assembly according to claim 1, wherein the shaving aid support comprises a body portion and the at least one shaft portion extends from the body portion.

6. The shaving blade assembly according to claim 5, wherein the body portion comprises a prism shaped section.

7. The shaving blade assembly according to claim 1, wherein the at least one blade comprises two or more blades arranged within the housing.

8. A razor comprising: the shaving blade assembly according to claim 1; and a handle connected to the shaving blade assembly.

9. The razor according to claim 8, wherein the handle is releasably connected to the shaving blade assembly.

10. A shaving blade assembly comprising:

at least one blade;

a housing having at least one cavity;

a shaving aid support that is rotatably attached to the housing about a central axis of the housing, wherein at least one shaft portion of the shaving aid support is disposed in the at least one cavity of the housing, wherein the shaving aid support has a first side and a second side, wherein the first side has a first lubricating element thereon and the second side has a second lubricating element thereon, and wherein the shaving aid support is in contact with a top portion of the housing when in a first position of the shaving aid support and is in contact with a bottom portion of the housing when in a second position of the shaving aid support.

11. A shaving blade assembly comprising:

at least one blade;

a housing having at least one cavity;

a shaving aid support that is rotatably attached to the housing about a central axis of the housing, wherein at least one shaft portion of the shaving aid support is disposed in the at least one cavity of the housing, wherein the shaving aid support has a first side and a second side, wherein the first side has a first lubricating element thereon and the second side has a second lubricating element thereon, and wherein the housing further includes at least one recess and the shaving aid support includes at least one pin, the recess and the pin being configured to removably lock together.

12. The shaving blade assembly according to claim 11, wherein the at least one recess is formed in a top portion of the housing.

13. The shaving blade assembly according to claim 11, wherein the at least one recess is formed in a top portion or a back portion of the housing.

14. A shaving blade assembly comprising:

at least one blade;

a housing having at least one cavity;

a shaving aid support that is rotatably attached to the housing about a central axis of the housing, wherein at least one shaft portion of the shaving aid support is disposed in the at least one cavity of the housing, wherein the shaving aid support has a first side and a second side, wherein the first side has a first lubricating element thereon and the second side has a second lubricating element thereon, and wherein the housing further includes a pair of prongs extending vertically from a top portion of the housing.

15. A shaving blade assembly comprising:

at least one blade;

a housing having at least one cavity;

a shaving aid support that is rotatably attached to the housing about a central axis of the housing, wherein at least one shaft portion of the shaving aid support is disposed in the at least one cavity of the housing, wherein the shaving aid support has a first side and a second side, wherein the first side has a first lubricating element thereon and the second side has a second lubricating element thereon, the shaving aid support comprises a body portion, and the shaft portion extends from the body portion, and wherein the body portion is U-shaped.

16. The shaving blade assembly of claim 15, wherein each of the sides has a substantially flat outer surface.

17. The shaving blade assembly of claim 15, wherein one or more of the first lubricating element and the second lubricating element comprise a two-layered structure.

18. The shaving blade assembly of claim 15, wherein the body portion comprises a prism shaped section.

19. The shaving blade assembly of claim 18, wherein the body portion comprises a rectangular base.

* * * * *